US010381120B2

(12) United States Patent
Bance et al.

(10) Patent No.: US 10,381,120 B2
(45) Date of Patent: Aug. 13, 2019

(54) STRUCTURE FOR DISSIPATING HEAT BY NATURAL CONVECTION, FOR PACKAGING FOR TRANSPORTING AND/OR STORING RADIOACTIVE MATERIALS

(71) Applicant: TN INTERNATIONAL, Montigny le Bretonneux (FR)

(72) Inventors: Kévin Bance, Versailles (FR); Olivier Bardon, Chaville (FR)

(73) Assignee: TN INTERNATIONAL, Montigny le Bretonneux (FR)

( * ) Notice: Subject to any disclaimer, the term of this patent is extended or adjusted under 35 U.S.C. 154(b) by 0 days.

(21) Appl. No.: 16/060,378

(22) PCT Filed: Dec. 13, 2016

(86) PCT No.: PCT/EP2016/080801
§ 371 (c)(1),
(2) Date: Jun. 7, 2018

(87) PCT Pub. No.: WO2017/102729
PCT Pub. Date: Jun. 22, 2017

(65) Prior Publication Data

US 2018/0374592 A1 Dec. 27, 2018

(30) Foreign Application Priority Data

Dec. 14, 2015 (FR) ..... 15 62301

(51) Int. Cl.
*G21F 5/002* (2006.01)
*G21F 5/008* (2006.01)
(Continued)

(52) U.S. Cl.
CPC ..... *G21F 5/002* (2013.01); *G21F 5/008* (2013.01); *G21F 5/10* (2013.01); *G21F 5/12* (2013.01); *F28D 9/0037* (2013.01); *G21F 5/005* (2013.01)

(58) Field of Classification Search
CPC ... G21F 5/002; G21F 5/12; G21F 5/10; G21F 5/008; G21F 5/005; F28D 9/0037
See application file for complete search history.

(56) References Cited

U.S. PATENT DOCUMENTS 3,727,059 A * 4/1973 Reese ..... G21F 5/005 165/185
2013/0322589 A1* 12/2013 Bracey ..... G21F 5/008 376/272

(Continued)

FOREIGN PATENT DOCUMENTS

DE 19 34 048 A1 1/1970
DE 29 10 115 A1 9/1980

OTHER PUBLICATIONS

International Search Report for International Application No. PCT/EP2016/080801, dated Mar. 3, 2017.

(Continued)

*Primary Examiner* — Syed Haider
(74) *Attorney, Agent, or Firm* — Pearne & Gordon LLP

(57) ABSTRACT

A structure for dissipating heat by natural convection, intended for being provided on the periphery of packaging for transporting and/or storing radioactive materials, the structure having two adjacent half-structures each comprising primary fins which are parallel and angled relative to a height direction of the structure, the primary fins of the two half-structures forming, in pairs, fins of the general shape of an inverted V when the packaging is arranged vertically with the bottom thereof oriented downwards.

10 Claims, 4 Drawing Sheets

(51) Int. Cl.

| | |
|---|---|
| ***G21F 5/10*** | (2006.01) |
| ***G21F 5/12*** | (2006.01) |
| *G21F 5/005* | (2006.01) |
| *F28D 9/00* | (2006.01) |

(56) References Cited

U.S. PATENT DOCUMENTS

| | | | | |
|---|---|---|---|---|
| 2015/0289416 | A1* | 10/2015 | Kim | H05K 7/20418 361/709 |
| 2015/0357066 | A1* | 12/2015 | Singh | G21F 5/14 405/129.55 |
| 2016/0035446 | A1* | 2/2016 | Cheng | G21F 5/008 376/272 |
| 2016/0284431 | A1* | 9/2016 | Arai | G21F 5/008 |
| 2018/0068752 | A1 | 3/2018 | Bardon et al. | |

OTHER PUBLICATIONS

Preliminary French Search Report for Application No. FR 15 62301, dated Sep. 9, 2016.

Written Opinion for International Application No. PCT/EP2016/080801, dated Mar. 3, 2017.

* cited by examiner

STRUCTURE FOR DISSIPATING HEAT BY NATURAL CONVECTION, FOR PACKAGING FOR TRANSPORTING AND/OR STORING RADIOACTIVE MATERIALS

This is a National Stage application of PCT international application PCT/EP2016/080801, filed on Dec. 13, 2016 which claims the priority of French Patent Application No. 15 62301, filed Dec. 14, 2015, both of which are incorporated herein by reference in its entirety.

TECHNICAL FIELD

The present invention relates to the field of evacuating the heat produced by radioactive materials loaded into packaging for transportation and/or storage of radioactive materials.

More precisely, the present invention relates to a structure for dissipating heat by natural convection, intended to be provided on the periphery of packaging for the transportation and/or storage of radioactive materials, for example assemblies of nuclear fuel or radioactive waste.

PRIOR ART

Assembling an external device for evacuating heat around an outer surface of a lateral body of packaging, with the goal of evacuating, to the surrounding environment, the calories emitted by the radioactive materials contained in the packaging is known from the prior art.

This device for evacuating heat is in particular designed in such a way as to limit the temperature reached during use by the various elements forming the packaging, in particular the joints and the radiological protection, in order to prevent any risk of degradation of these elements.

Moreover, besides being able to ensure its main function of exchanger of calories with the surrounding environment, this device is designed in such a way as to be compatible with the constraints of services of the packaging, such as decontaminability, resistance over time, resistance to atmospheric stresses, resistance to the conditions of use such as immersion during loading and unloading, or the confinement of the neutron-shielding resin.

A known solution for this type of external device for evacuating heat is in the form of an outer shell enveloping the lateral body of the packaging, and onto which longitudinal straight fins having the appropriate cross-section are welded. These fins are also called vertical, since they are oriented in the vertical direction when the packaging is itself at rest vertically.

This solution, however, can be perfected since in practice, it leads to a temperature profile that progressively increases according to the height of the packaging, when the latter is at rest vertically.

DISCLOSURE OF THE INVENTION

The goal of the invention is therefore to at least partially overcome the disadvantage mentioned above, with respect to the embodiments of the prior art.

To do this, the object of the invention is first of all a structure for dissipating heat by natural convection, intended to be provided on the periphery of packaging for the transportation and/or storage of radioactive materials, the structure having two adjacent half-structures each comprising primary fins that are parallel and inclined with respect to a direction of the height of the structure, the primary fins of the two half-structures forming, two by two, fins having the overall shape of an inverted V, when the packaging is arranged vertically with its bottom oriented downwards, the structure having the following parameters:

- H: the height of each half-structure, in the direction of the height along which the inclined primary fins are successively arranged, this height being between 2 and 5 m;
- h: the height of each primary fin, between 10 and 100 mm;
- d: the width of each primary channel for circulation of air defined between two directly consecutive primary fins, this width being between 10 and 50 mm;
- Ep: the thickness of each primary fin, satisfying the condition d/Ep≥2.5;
- L: the width of each half-structure in a transverse direction orthogonal to the direction of the height, said width L satisfying the following condition:

$$0.30\cdot(0.35\cdot H^{0.5}\cdot h^{0.6}/d^{0.1})\leq L\leq 3.5\cdot(0.35\cdot H^{0.5}\cdot h^{0.6}/d^{0.1})$$

The specific geometric conditions defined above allow the convective performance of the fins to be substantially improved, in particular with respect to the vertical straight fins known from the prior art. Moreover, surprisingly, it was observed that with these specific dimensions, there is advantageously a phenomenon of acceleration of the particles of air in the primary channels, which provides increased thermal performance. This phenomenon is the result of the interaction between the zones for air intake at the inlet of the primary channels and the outlet zones located farther downstream of these channels. More precisely, a portion of the particles of air of the outlet zones is recycled in the form of an eddy that allows more cool air to be drawn to the inlet of these same channels. In other words, these eddies created above the fins and above the primary channels, promote the acceleration of the air in the latter. Due to this phenomenon of eddying used in the present invention, the gains in terms of thermal performance are at least approximately 10% with respect to the solutions with vertical fins, given equal thermal exchange surfaces.

The invention also has at least one of the following optional features, taken alone or in combination.

The two adjacent half-structures are arranged in a substantially symmetrical manner.

The structure has an optional spacing Ec between the facing ends of two primary fins together forming a fin having the overall shape of an inverted V, the two facing ends forming the apex of the V, this spacing Ec satisfying the condition Ec/L≤0.2.

The primary fins are straight and inclined by a value between 30 and 60° with respect to the direction of the height, and preferably inclined by a value of 45° with respect to this same direction.

The width d is constant and identical for all the primary channels for circulation of air of each half-structure.

The width L of each half-structure satisfies the following more precise condition:

$$0.55\cdot(0.35\cdot H^{0.5}\cdot h^{0.6}/d^{0.1})\leq L\leq 1.8\cdot(0.35\cdot H^{0.5}\cdot h^{0.6}/d^{0.1})$$

In this restricted range of values, the convective performance of the fins is further increased. The gains in terms of thermal performance are at least approximately 25% with respect to the solution having vertical fins, given equal thermal exchange surfaces.

The two half-structures are distinct from one another, each having a plate and its own primary fins that protrude from the plate. This provides ease of manufacturing and assembly.

Alternatively, the two half-structures can be made on the same plate having a height H.

Each half-structure is substantially flat, which here also provides ease of manufacturing.

The object of the invention is also packaging for the transportation and/or the storage of radioactive materials, comprising a lateral body provided on the outside with a plurality of structures for dissipating heat like that described above, these structures being distributed circumferentially around the lateral body.

Preferably, a spacing Ec' between two dissipation structures directly adjacent in the circumferential direction, is substantially equal to the spacing Ec.

Other advantages and features of the invention will be clear from the non-limiting detailed description below.

BRIEF DESCRIPTION OF THE DRAWINGS

This description is given with regard to the appended drawings, among which.

DETAILED DESCRIPTION OF PREFERRED EMBODIMENTS

Figure 1:
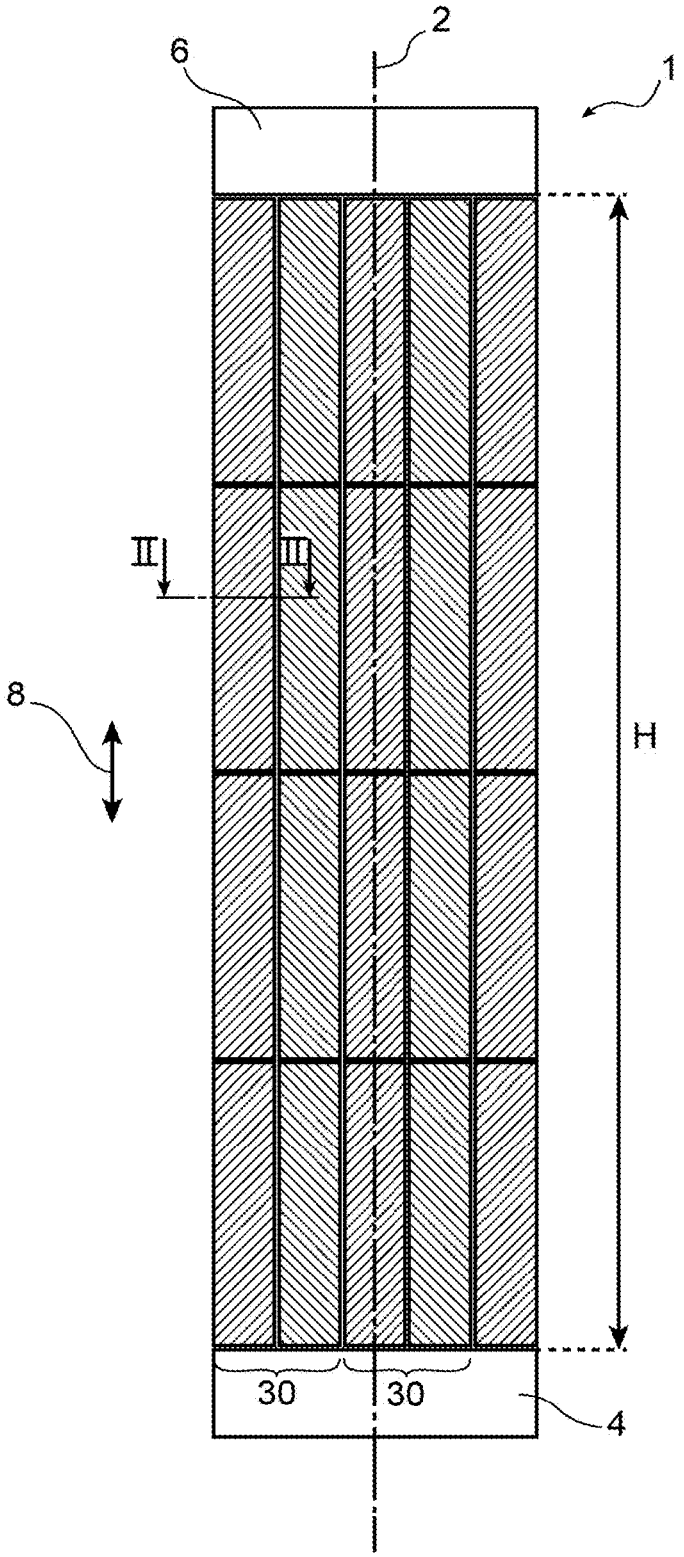
FIG. 1 shows a front view of packaging for the storage and/or transportation of radioactive materials, comprising a structure for dissipating heat according to a preferred embodiment of the present invention.
Figure 2:
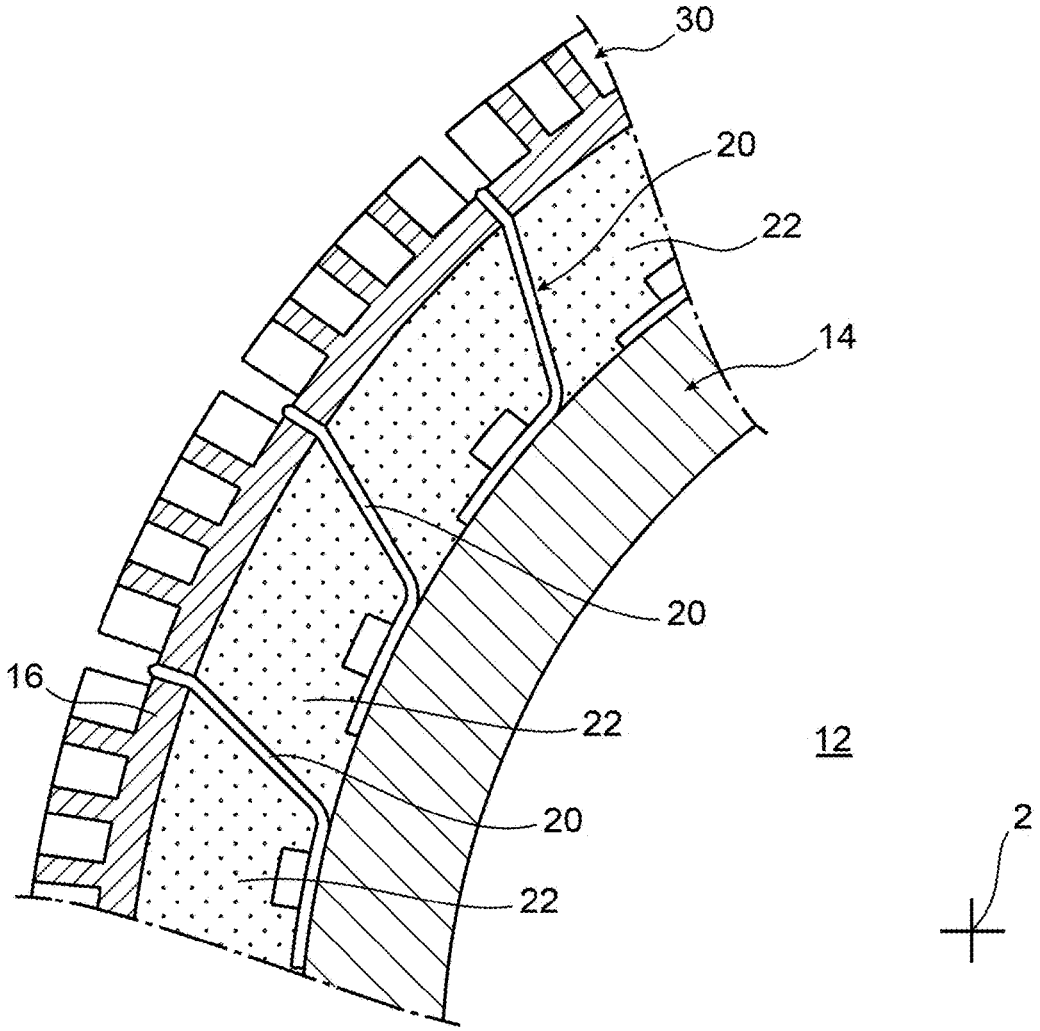
FIG. 2 shows a partial cross-sectional view along the line II-II of FIG. 1.

In reference first of all to FIGS. 1 and 2, packaging 1 for the storage and/or transportation of radioactive materials, such as assemblies of nuclear fuel or radioactive waste (not shown), is shown.

This packaging 1 is shown in FIG. 1 in a vertical storage position, in which its longitudinal axis 2 is oriented vertically. It rests on a packaging bottom 4, opposite to a removable cover 6 in the direction of the height 8, parallel to the longitudinal axis 2. Between the bottom 4 and the cover 6, the packaging 1 comprises a lateral body 10 extending around the axis 2, and defining on the inside a cavity 12 for the housing of the radioactive materials.

The lateral body 10 generally comprises an inner shell 14 and an outer shell 16 that are concentric, defining an annular space 18 centred on the axis 2. The space 18 is filled by thermal-conduction means 20 connecting the two shells 14, 16, as well as by neutron-protection means 22. The means 20, 22 mentioned above have a conventional design and will not therefore be described in more detail.

The outer shell 16 is made using a plurality of structures 30 for dissipating heat according to the invention. These structures 30 are distributed circumferentially around the axis 2, and extend each along a height H between 2 and 5 m in the direction of the height 8. In the example shown in FIG. 2, the structures 30 comprise bases in the shape of rectangular plates, these plates each comprise two longitudinal edges. These plates are assembled end to end via welding at their facing edges, in such a way as to reform the outer shell 16.

Figure 3:
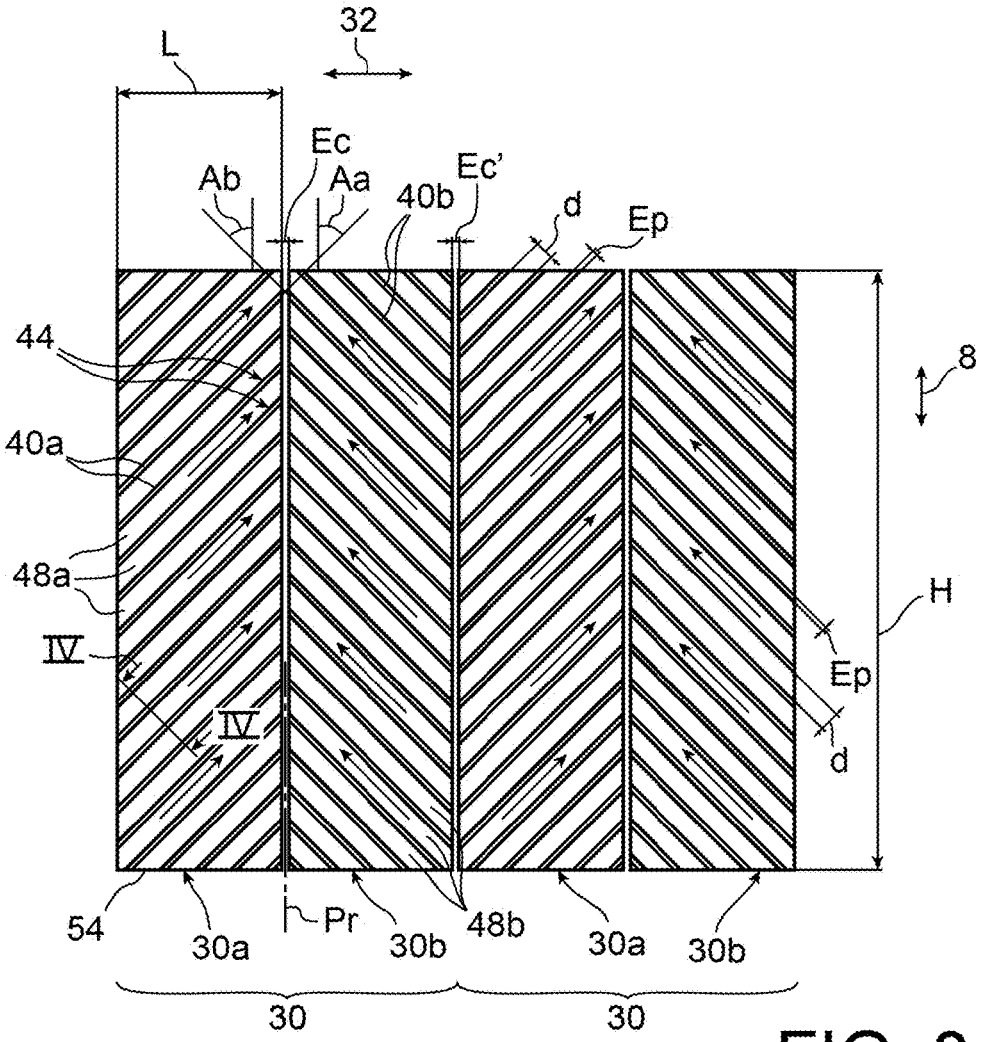
FIG. 3 is an enlarged front view of a portion of the structure for dissipating heat.

More precisely in reference to FIG. 3, two structures 30 adjacent in the circumferential direction 32 of the packaging are shown. These two structures 30 are identical, and this is preferably true for all the structures 30 forming the outer shell 16, the number of which can be between 5 and 40.

Each structure for dissipating heat 30 comprises two half-structures 30*a*, 30*b* having analogous designs, and arranged substantially symmetrically with respect to a radial plane Pr of the packaging. The half-structure 30*a* comprises straight and parallel primary fins 40*a*. They are inclined with respect to the direction of the height 8 of the packaging, also corresponding to the height direction of the structure 30. The angle of inclination Aa of the primary fins 40*a* with respect to the direction 8 is preferably approximately 45°. In an analogous and substantially symmetrical manner, the half-structure 30*b* comprises straight and parallel primary fins 40*b*. They are inclined with respect to the direction of the height 8 of the packaging, by an angle of inclination Ab preferably of approximately 45°. Nevertheless, the symmetry can be imperfect, for example by providing a slight different in the value of the two angles Aa, Ab of approximately 10 to 20°.

The primary fins 40*a*, 40*b* of the two half-structures form, two by two, fins 44 having the overall shape of an inverted V, when the packaging is arranged vertically with its bottom oriented downwards, like in FIGS. 1 and 3. Each fin 44 thus formed by one of the primary fins 40*a*, and the facing primary fin 40*b*, thus takes the shape of a chevron.

Each half structure 30*a*, 30*b* can be made from a single part in the direction 8, or be segmented in this same direction. In the latter case illustrated in FIG. 1, the half-structure segments are then arranged as an extension of one another, by being welded end to end.

Figure 4:
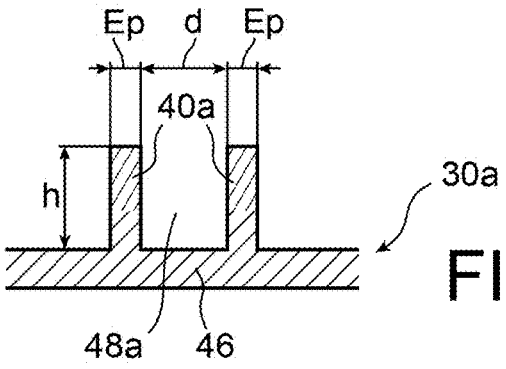
FIG. 4 is a cross-sectional view along the line IV-IV of FIG. 3.

Preferably, the two half-structures 30*a*, 30*b* are distinct from one another, namely they each comprise a plate 46 from which the associated primary fins protrude, as shown for the half-structure 30*a* in FIG. 4. The two plates 46 are assembled together via welding at their edges that face each other in the circumferential direction, in such a way as to reform a structure 30. Thus, the two assembled plates 46 together form the aforementioned base in the shape of a rectangular plate, which participates in reforming the outer shell 16.

As shown in FIG. 3, the two half-structures 30*a*, 30*b* have a symmetrical design. In this same FIG. 3, the primary channels 48*a*, 48*b* defined, respectively, by two directly consecutive fins 40*a*, 40*b*, in the direction 8, are also shown.

FIGS. 3 and 4 identify decisive geometric parameters for obtaining the unexpected thermal performance, which is particularly high.

These involve first of all the height H of each half-structure 30*a*, 30*b*, corresponding to the height H of the structure 30 consisting of these two half-structure. As indicated above, the height H is between 2 and 5 m, and preferably close to 4 m.

These also involve the height h of each primary fin 40*a*, 40*b*, between 10 and 100 mm, and preferably identical for all the primary fins.

The width d of each primary channel for circulation of air 48*a*, 48*b* is also part of these important parameters. This width d is between 10 and 50 mm, and is constant and identical for all the channels 48*a*, 48*b*, over the entire height H.

These also involve the thickness Ep of each primary fin 40*a*, 40*b*, which satisfies the condition $d/Ep \geq 2.5$. This thickness Ep is also preferably identical for all the primary fins.

Finally, the width L of each half-structure 30*a*, 30*b* is also a key parameter. This width L, which extends in a transverse direction orthogonal to the direction of the height and can be likened to the circumferential direction 32, is identical for the two half-structures and satisfies the following condition:

$$0.30\cdot(0.35\cdot H^{0.5}\cdot h^{0.6}/d^{0.1})\leq L\leq 3.5\cdot(0.35\cdot H^{0.5}\cdot h^{0.6}/d^{0.1})$$

Moreover, an optional spacing Ec can be provided between the facing ends of two primary fins 40*a*, 40*b*, together forming a fin having the overall shape of an inverted V 44. This spacing, arranged at the tip of the fin 44, satisfies the condition Ec/L 0.2. Since the spacings are aligned in the direction 8, together they form a sort of vertical channel 54 for air outlet, at the junction between the two half-structures 30*a*, 30*b* of the structure 30 for dissipating heat.

Moreover, there is preferably a spacing Ec' between two dissipation structures 30 directly adjacent in the circumferential direction 32. This spacing Ec' is for example substantially equal to the spacing Ec.

This combination of geometric parameters provides very good thermal performance, which is even greater when these parameters satisfy the following condition:

$$0.55\cdot(0.35\cdot H^{0.5}\cdot h^{0.6}/d^{0.1})\leq L\leq 1.8\cdot(\mathbf{0.35}\cdot H^{0.5}\cdot h^{0.6}/d^{0.1})$$

Even more preferably, the gain in thermal performance can reach up to 90% with respect to the conventional solution with vertical straight fins, when the width L approaches the specific value defined by the following product: $0.35\cdot H^{0.5}\cdot h^{0.6}/d^{0.1}$.

In all the cases mentioned above, the gain in thermal performance is explained unexpectedly and surprisingly by the obtaining of a phenomenon of acceleration of the particles of air in the primary channels 48*a* 48*b*. This acceleration of the air in the channels, sketched by the arrows 56 in FIG. 5, results from the interaction between the zones for air intake 58 at the inlet of the channels 48*a*, 48*b*, and the outlet zones 60 located farther downstream of these channels. In this FIG. 5, the zones for air intake 58 correspond to the dark grey portions, in the shape of a triangle with the vertex oriented upwards. This is explained by the fact that these intake zones 58, in the channels 48*a*, 48*b*, are more extended towards the bottom. Inversely, the outlet zones 60 correspond to the lighter grey portions, in the shape of a triangle with the vertex oriented downwards. This is explained by the fact that these outlet zones are more extended towards the top.

Figure 5:
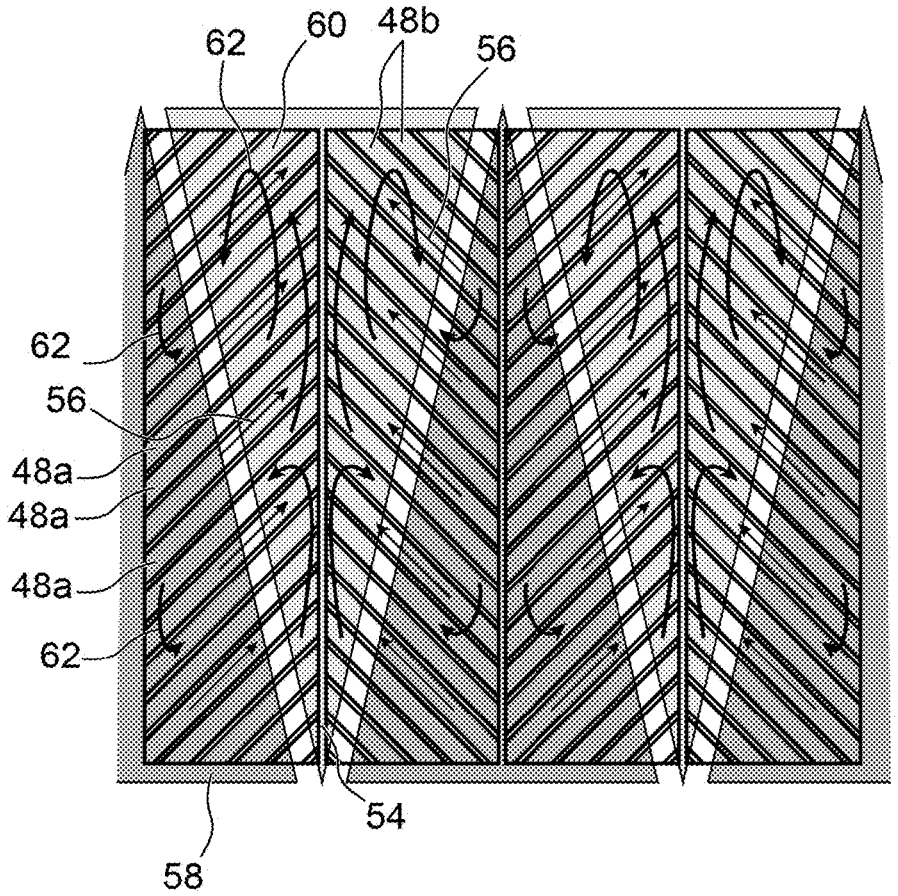
FIG. 5 is a similar view to that of FIG. 3, in which the principle of eddying of air above the fins and above the primary channels of the structure for dissipating heat has been sketched.

With the proposed arrangement, when the half-structures are heated, there is natural convection that leads the air to enter the primary channels 48*a*, 48*b*, then propagate upwards in these channels, before meeting the air coming from the facing channels belonging to the other half-structure. This impact at the outlet of the primary channels 48*a*, 48*b*, at the tip of the inverted Vs, leads the air to be evacuated vertically upwards. But simultaneously, because of the controlled proportion between the extent of the intake zones 58 and the extent of the outlet zone 60 resulting from the specific geometric parameter implemented in the invention, there are eddies and recirculation of air above the fins and above the primary channels 48*a*, 48*b*, which promote the acceleration of the air in these channels. These eddies, sketched by the arrows 62 in FIG. 5, are obtained because a portion of the particles of air in the outlet zones 60 is drawn again into the primary channels 48*a*, 48*b* while being driven by the intake zones 58, while particles of air in the intake zones 58 are driven by the outlet zones 60.

Of course, various modifications can be made by a person skilled in the art to the invention described above, only as non-limiting examples.

What is claimed is:

1. Structure for dissipating heat by natural convection, to be provided on the periphery of packaging for the transportation and/or storage of radioactive materials, the structure being characterised in that it has two adjacent half-structures each comprising primary fins that are parallel and inclined with respect to a direction of the height of the structure, the primary fins of the two half-structures forming, two by two, fins having the overall shape of an inverted V, when the packaging is arranged vertically with its bottom oriented downwards, the structure having the following parameters:

H is the height of each half-structure, in the direction of the height along which the inclined primary fins are successively arranged, this height being between 2 and 5 m;

h is the height of each primary fin, between 10 and 100 mm;

d is the width of each primary channel for circulation of air defined between two directly consecutive primary fins, this width being between 10 and 50 mm;

Ep is the thickness of each primary fin, satisfying the condition d/Ep≥2.5;

L is the width of each half-structure in a transverse direction orthogonal to the direction of the height, said width L satisfying the following condition:

$$0.30\cdot(0.35\cdot H^{0.5}\cdot h^{0.6}/d^{0.1})\leq L\leq 3.5\cdot(0.35\cdot H^{0.5}\cdot h^{0.6}/d^{0.1}).$$

2. Structure for dissipating heat according to claim 1, wherein the two adjacent half-structures are arranged in a symmetrical manner.

3. Structure for dissipating heat according to claim 1, wherein the primary fins are straight and inclined by a value between 30 and 60° with respect to the direction of the height, and preferably inclined by a value of 45° with respect to this same direction.

4. Structure for dissipating heat according to claim 1, wherein the width d is constant and identical for all the primary channels for circulation of air of each half-structure.

5. Structure for dissipating heat according to claim 1, wherein the width L of each half-structure satisfies the following condition:

$$0.55\cdot(0.35\cdot H^{0.5}\cdot h^{0.6}/d^{0.1})\leq L\leq 1.8\cdot(0.35\cdot H^{0.5}\cdot h^{0.6}/d^{0.1})$$

6. Structure for dissipating heat according to claim 1, wherein the two half-structures are distinct from each other, each having a plate and its own primary fins that protrude from the plate.

7. Structure for dissipating heat according to claim 1, wherein the two half-structures are made on the same plate having a height H.

8. Structure for dissipating heat according to claim 1, wherein that each half-structure is flat.

9. Packaging for the transportation and/or the storage of radioactive materials, comprising a lateral body provided on the outside with a plurality of structures for dissipating heat according to claim 1, distributed circumferentially around the lateral body.

10. Packaging according to claim 9, wherein a spacing Ec' between two dissipation structures directly adjacent in the circumferential direction, is equal to the spacing Ec.

* * * * *